United States Patent [19]

Wingert et al.

[11] Patent Number: 4,817,695

[45] Date of Patent: Apr. 4, 1989

[54] ELECTRICAL CONTACT MATERIAL OF AG, $SNO_2$, $GEO_2$ AND $IN_2O_3$

[76] Inventors: Philip C. Wingert, 1711 Three Meadows Rd., Greensboro, N.C. 27408; Charles Brecher, 9 Skyview Rd., Lexington, Mass. 02173; Han J. Kim, 342 Silver Hill Rd., Concord, Mass. 01742; Shinhoo Kang, 78 Concord Rd., Wayland, Mass. 01778

[21] Appl. No.: 127,845

[22] Filed: Dec. 2, 1987

[51] Int. Cl.[4] ..... C22C 5/06

[52] U.S. Cl. ..... 148/431; 428/929; 200/266

[58] Field of Search ..... 148/430, 431; 75/234, 75/252; 200/265, 266; 428/929

[56] References Cited

U.S. PATENT DOCUMENTS

| | | | |
|---|---|---|---|
| 3,933,485 | 1/1976 | Shibata | 148/431 |
| 4,294,616 | 10/1981 | Kim et al. | 75/234 |
| 4,410,491 | 10/1983 | Böhn et al. | 420/501 |
| 4,672,008 | 6/1987 | Shibata | 428/673 |

FOREIGN PATENT DOCUMENTS

| | | | |
|---|---|---|---|
| 2933338 | 2/1981 | German Democratic Rep. | 420/501 |
| 27219 | 7/1974 | Japan | 420/501 |
| 15408 | 2/1979 | Japan | 420/501 |
| 23024 | 2/1979 | Japan | 420/501 |
| 43776 | 3/1980 | Japan | 420/501 |
| 119749 | 9/1981 | Japan | 148/431 |
| 156743 | 12/1981 | Japan | 148/431 |

*Primary Examiner*—Christopher W. Brody

[57] ABSTRACT

A material for electrical contact use has the following composition: 6 to 18 percent tin oxide, 0.25 to 1% germanium oxide, 0.2 to 2% indium oxide, balance silver, all percentages by weight. The material exhibits superior erosion characterstics.

3 Claims, 1 Drawing Sheet

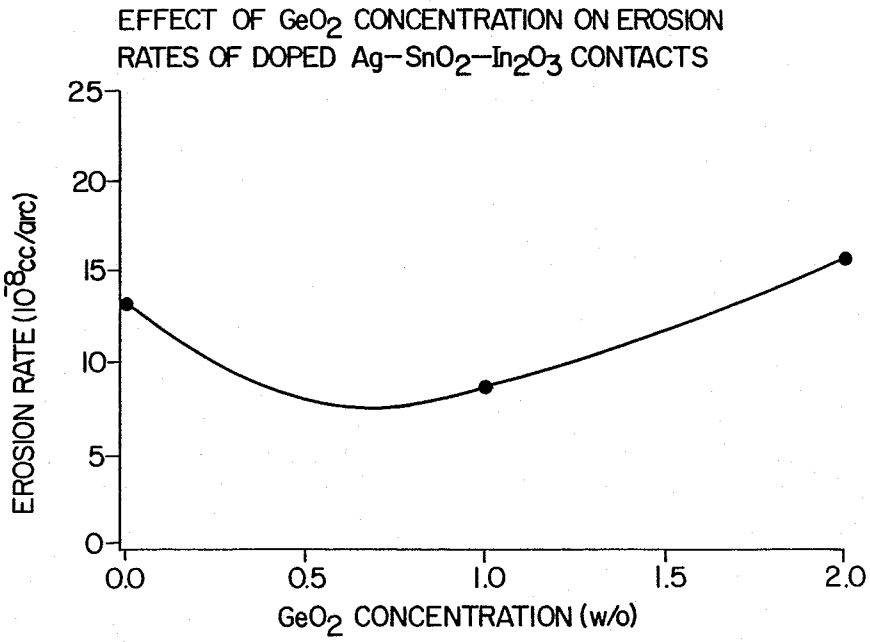
EFFECT OF $GeO_2$ CONCENTRATION ON EROSION RATES OF DOPED $Ag-SnO_2-In_2O_3$ CONTACTS
EROSION RATE ($10^{-8}$cc/arc)
25
20
15
10
5
0
0.0
0.5
1.0
1.5
2.0
$GeO_2$ CONCENTRATION (w/o)

ELECTRICAL CONTACT MATERIAL OF AG, $SNO_2$, $GEO_2$ AND $IN_2$ $O_3$

This invention concerns silver electrical contacts, specifically, such contacts containing tin oxide, indium oxide and germanium oxide. Examples of silver contacts containing tin and indium oxides are disclosed in U.S. Pat. Nos. 3,874,941, 3,933,485, 4,050,930, 4,072,515, 4,150,982, 4,243,413 and 4,452,652. These patents cover internally oxidized type contact materials. In them the indium is added as a metal to make a totally metallic silver-tin-indium single phase alloy. This alloy is then internally oxidized at some stage to form the silver-tin oxide-indium oxide contact material. The indium component is necessary to allow the single phase alloys with major percentages of tin to be oxidized internally. Without the indium the oxide would form externally and the materials would have no value as contact materials. The inclusion of germanium oxide with tin oxide in contact materials is disclosed in U.S. Pat. Nos. 4,294,616 and 4,410,491. The latter patent discloses that germanium oxide reduces excess switching temperature and reduces weld strength.

We have found that superior erosion results are obtained with electrical contacts made using strictly powder mixing, pressing, and sintering techniques and having the following composition: 6 to 18% tin oxide, 0.25 to 1% germanium oxide, 0.2 to 2% indium oxide, balance silver, all percentages by weight. Having the combination of germanium oxide and indium oxide is necessary to obtain the improved erosion characteristics described. Optimum composition ranges are 0.4–0.8% germanium oxide and 0.4–1.0% indium oxide by weight. These are added to the initial powder mix as oxide powders.

Internal oxidation of silver-tin oxide-indium oxide contact materials yields an inhomogeneous microstructure. There are typically a thin layer of very fine oxides at the surface, continuous strings of oxides on silver grain boundaries and fine or acicular oxides within the grains in the bulk of the material, and a central zone generally of low or zero oxide content. The nonuniform microstructure tends to make the contact behavior of the material inconsistent as it is eroded away. The grain boundary and acicular oxides tend to be conductive to the formation of large cracks which can cause catastrophic failure.

Powder metallurgically produced contacts have homogenous microstructures with fine (2 micron) oxide particles evenly distributed throughout the silver matrix. The uniform distribution of fine oxides tends to make the erosion more even over the whole contact surface and make the contact behavior more consistent as the material is eroded away.

The drawing shows erosion rate versus germanium oxide concentration for one example of contacts as per this invention after 100,000 cycles of operation.

Contacts having a composition as per this invention were fabricated and then brazed to form assemblies for electrical testing. The contacts should be fabricated to have a final density of more than 95% of theoretical density.

The assemblies used in the tests to be described were made as follows. The components in powder form were mixed, pressed and then sintered with a silver backing layer to approximately 91% of theoretical density. The parts were then hot coined at 400° C. to more than 99% of theoretical density. The contacts were then brazed to studs and put into modified single-break clapper-type relays for electrical endurance testing. The relays used for electrical testing were typical of NEMA size 1 or 2 contactors (i.e. opening velocity of 30 cm/sec., closing velocity 40 cm/sec., closed force 400 gms, and bounce time 12 ms). No arc-quenching apparatus was incorporated in the test relays. Contact diameters of both 0.352" and 0.250" were tested. The contacts had a 2" radius of curvature on their mating faces at the start of the test. A 60 Hz alternating current of 100 A rms with a power factor of 0.35 was made and broken by the relays in the test. The relays were cycled every 9 seconds with 1 second of time on and 8 seconds off.

Contacts in which the percentages $GeO_2$ and $In_2O_3$ varied between 0 and 2 weight percent were endurance tested. The effects of the differing percentages of $GeO_2$ and $In_2O_3$ were evaluated by measuring the final erosion rates in 100,000 cycle tests. Best behavior was exhibited by parts in the concentration ranges of 0.25 to 1.0 wt. % $GeO_2$ and 0.2 to 2% $In_2O_3$. The composition of the contacts tested to yield the results shown in the drawing were 0.5 wt. % $In_2O_3$, $GeO_2$ as indicated $SnP_2$ to yield a total oxide content of 18.6 vol. %, and balance silver.

The following methods may be used to make electrical contacts in accordance with this invention. It is a requirement that the contacts have a high final density greater than 95% of theoretical density.

Press the mixed powder into a compact, then hot isostatically press the material to high density. Individual contacts could be made this way or a billet could be made which would require further forming steps.

The mixed powder could be pressed into a billet which could then be sintered and extruded to yield high density material which could then be made into contacts.

The mixed powder could be pressed into a slab which could be sintered, hot rolled to high density, and then subsequently formed into contacts.

The mixed powder could be pressed, sintered, and then repressed or hot repressed to yield a contact with high final density.

We claim:

1. An electrical contact having at least 95% theoretical density and having the following composition, by weight: 6 to 18% $SnO_2$, 0.25 to 1% $GeO_2$, 0.2 to 2% $In_2O_3Ag$, said $SnO_2$, $GeO_2$ and $In_2O_3$ being homogeneously distributed within the silver matrix.

2. The electrical contact of claim 1 wherein the $GeO_2$ content is 0.4 to 0.8%.

3. The electrical contact of claim 1 wherein the $In_2O_3$ content is 0.4 to 1.0%.

* * * * *

UNITED STATES PATENT AND TRADEMARK OFFICE

CERTIFICATE OF CORRECTION

PATENT NO. :4,817,695

DATED April 4, 1989

INVENTOR(S) : Wingert et al

It is certified that error appears in the above—identified patent and that said Letters Patent is hereby corrected as shown below:

Column 2, line 55, between "$In_2O_3$" and "Ag" insert ---, balance---

Column 2, line 61, add ---4. The electrical contact according to claim 1 wherein the homogeneously distributed oxide particles are each less than about 2 microns.---

Signed and Sealed this

Third Day of October, 1989

*Attest:*

DONALD J. QUIGG

*Attesting Officer*

*Commissioner of Patents and Trademarks*